US012144429B2

(12) United States Patent
Leng

(10) Patent No.: US 12,144,429 B2
(45) Date of Patent: Nov. 19, 2024

(54) FOLDABLE PLASTIC-STEEL CHAIR

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 179 days.

(21) Appl. No.: 17/872,321

(22) Filed: Jul. 25, 2022

(65) Prior Publication Data

US 2022/0354256 A1 Nov. 10, 2022

Related U.S. Application Data

(63) Continuation of application No. PCT/CN2021/078154, filed on Feb. 26, 2021.

(30) Foreign Application Priority Data

Sep. 29, 2020 (CN) ..... 202011052435.2

(51) Int. Cl.
*A47C 4/18* (2006.01)
*A47C 4/14* (2006.01)
(Continued)

(52) U.S. Cl.
CPC ..... *A47C 4/14* (2013.01); *A47C 4/18* (2013.01); *A47C 4/20* (2013.01); *A47C 4/42* (2013.01);
(Continued)

(58) Field of Classification Search
CPC .... A47C 4/14; A47C 4/18; A47C 4/20; A47C 4/42; A47C 4/44; A47C 4/48;
(Continued)

(56) References Cited

U.S. PATENT DOCUMENTS 2,390,878 A * 12/1945 Greitzer ..... A47C 3/023 297/DIG. 2
2,865,437 A * 12/1958 Shwayder ..... A47C 7/16 297/55
(Continued)

FOREIGN PATENT DOCUMENTS

CN 2638637 Y 9/2004
CN 1618371 A 5/2005
(Continued)

OTHER PUBLICATIONS 3 page PDF of an English translation of the written opinioned mailed Apr. 28, 2021 for PCT/CN2021/078154. (Year: 2021).*
(Continued)

*Primary Examiner* — Robert Canfield
(74) *Attorney, Agent, or Firm* — Cooper Legal Group, LLC

(57) ABSTRACT

A foldable plastic-steel chair comprises a seat board assembly, a backrest, and a metal supporting frame. The seat board assembly and the backrest are connected to the metal supporting frame, and the seat board assembly comprises a seat board. The seat board comprises a surface plate and a surrounding edge connected to a periphery of the surface plate and extending downward, and the seat board is a vacuum-formed plastic board. The seat board assembly further comprises a metal frame abutting a periphery of seat board, and a bottom end of the metal frame is bent outward to form a hook. A lower end portion of the surrounding edge of the seat board is disposed in the hook, and a portion of the metal frame abuts an inner side of the surrounding edge. The hook is fixedly clamped to a lower edge of the surrounding edge.

20 Claims, 13 Drawing Sheets

(51) Int. Cl.

| | |
|---|---|
| ***A47C 4/20*** | (2006.01) |
| ***A47C 4/42*** | (2006.01) |
| ***A47C 4/44*** | (2006.01) |
| ***A47C 4/48*** | (2006.01) |
| ***A47C 5/04*** | (2006.01) |
| ***A47C 5/06*** | (2006.01) |
| ***A47C 5/12*** | (2006.01) |

(52) U.S. Cl.
CPC ..... *A47C 4/44* (2013.01); *A47C 4/48* (2013.01); *A47C 5/043* (2013.01); *A47C 5/06* (2013.01); *A47C 5/12* (2013.01)

(58) Field of Classification Search
CPC .. A47C 5/043; A47C 5/06; A47C 5/12; A47C 4/24; A47C 5/10; A47C 7/16; A47C 5/04; A47C 7/40
USPC ..... 297/23, 56, 440.22, 452.55, 452.14
See application file for complete search history.

(56) References Cited

U.S. PATENT DOCUMENTS

| | | | | | |
|---|---|---|---|---|---|
| 3,159,428 | A * | 12/1964 | Schier | A47C 5/043 297/DIG. 2 |
| 3,253,860 | A * | 5/1966 | Shapiro | A47D 1/106 297/451.3 |
| 3,431,022 | A * | 3/1969 | Poppe | A47C 31/023 297/440.22 |
| 3,659,898 | A * | 5/1972 | Yellin | A47C 5/06 297/DIG. 2 |
| 3,695,687 | A * | 10/1972 | Uyeda | A47C 4/24 297/56 |
| 5,645,321 | A * | 7/1997 | Seroldi | A47C 31/04 5/403 |
| 6,345,863 | B1 * | 2/2002 | Laws | A47C 4/24 297/56 |
| 6,612,654 | B2 * | 9/2003 | Laws | A47C 31/02 297/440.22 |
| 7,014,261 | B2 | 3/2006 | Haney | |
| 11,140,986 | B2 * | 10/2021 | Leng | F16B 5/0004 |
| 2003/0034676 | A1 | 2/2003 | Wen et al. | |
| 2004/0239153 | A1 * | 12/2004 | Leng | A47C 4/20 297/56 |
| 2010/0237678 | A1 * | 9/2010 | Leng | A47C 7/42 297/452.1 |
| 2019/0290003 | A1 * | 9/2019 | Leng | B32B 3/08 |
| 2021/0177138 | A1 * | 6/2021 | Leng | A47B 13/083 |

FOREIGN PATENT DOCUMENTS

| | | | | | |
|---|---|---|---|---|---|
| CN | 102595972 | A | | 7/2012 | |
| CN | 202681210 | U | | 1/2013 | |
| CN | 205125621 | U | | 4/2016 | |
| CN | 112535371 | A | * | 3/2021 | A47C 4/14 |
| CN | 214072580 | U | * | 8/2021 | |
| CN | 214072591 | U | * | 8/2021 | |
| CN | 217852047 | U | * | 11/2022 | |
| EP | 2478797 | B1 | | 9/2013 | |
| ES | 157808 | U | | 6/1970 | |
| FR | 2263729 | B3 | | 12/1976 | |
| KR | 20010075797 | A | | 8/2001 | |

OTHER PUBLICATIONS

International Search Report and English Translation cited in PCT/CN2021/078154, mailed Apr. 28, 2021, 8 pages.
Corresponding European Patent Application No. 21873812.8, Supplementary Search Report dated May 21, 2024.
Corresponding European Patent Application No. 21873812.8, Communication pursuant to Article 94(3) dated Jun. 21, 2024.
Corresponding Australian Patent Application No. 2021353224, Examination Report dated Apr. 11, 2024.

* cited by examiner

FOLDABLE PLASTIC-STEEL CHAIR

RELATED APPLICATIONS

This application is a continuation of international patent application number PCT/CN2021/078154, filed on Feb. 26, 2021, which claims priority to Chinese patent application number 202011052435.2, filed on Sep. 29, 2020. International patent application number PCT/CN2021/078154 and Chinese patent application number 202011052435.2 are incorporated herein by reference.

FIELD OF THE DISCLOSURE

The present disclosure relates to a chair, and in particular to a foldable plastic-steel chair.

BACKGROUND OF THE DISCLOSURE

Plastic-steel chairs are chairs with a metal supporting frame for support and a plastic plate used as a seat board and a backrest. The most common structure in daily life is a structure of an iron pipe supporting frame and an injection-molded plate. Generally speaking, the plastic-steel chairs have a lower cost, and a market price is not high, so it is one of the commonly used household items in ordinary family life.

Comparing the seat board with the backrest, it is obvious that the seat board needs higher strength requirements. As such, a thickness of the plastic plate needs to increase to meet the strength requirements. Therefore, injection molding is used. If the plastic plate is made by rotomolding, the thickness of the plastic plate is greater. Moreover, horizontal ribs and vertical stiffening ribs are arranged at a bottom of the plastic plate, and the manufacturing cost will increase accordingly. In addition, the backrest is either locked on the metal supporting frame or inserted into the metal supporting frame. If the backrest is locked on the metal supporting frame, the backrest has screw holes, and it is easy to damage the backrest when tightening screws. If the backrest is inserted onto the metal supporting frame, the backrest can be removed at will, and the structure is not strong enough.

Therefore, the plastic-steel chairs that are very economical for ordinary families have not changed for many years. It seems that the structure can no longer be simplified and the cost cannot be reduced. How to further reduce the manufacturing cost effectively and make the backrest be more firmly connected to the metal supporting frame to improve the market competitiveness of the products make it necessary to creatively improve the structure of the plastic-steel chairs.

BRIEF SUMMARY OF THE DISCLOSURE

The present disclosure provides a foldable plastic-steel chair, which effectively reduces the manufacturing cost and has a firm structure. A technical solution of the present disclosure is as follows.

A foldable plastic-steel chair comprises a seat board assembly, a backrest, and a metal supporting frame. The seat board assembly and the backrest are connected to the metal supporting frame. The seat board assembly comprises a seat board, and the seat board comprises a surface plate and a surrounding edge connected to a periphery of the surface plate and extending downward. The seat board is a vacuum-formed plastic board. The seat board assembly further comprises a metal frame abutting a periphery of seat board.

A bottom end of the metal frame is bent outward to form a hook. A lower end portion of the surrounding edge of the seat board is disposed in the hook. A portion of the metal frame abuts an inner side of the surrounding edge, and the hook is fixedly clamped to a lower edge of the surrounding edge. The backrest is a second vacuum-formed plastic board, and an upper edge of the backrest is at least folded rearward to form a buckle edge. The metal supporting frame comprises a slot or an insertion groove corresponding to the buckle edge, and the buckle edge is disposed in the slot or the insertion groove. The slot or the insertion groove is configured to be pressed to enable the buckle edge to be fixedly clamped by the slot or the insertion groove.

Compared with the existing techniques, the technical solution has the following advantages.

1. The metal frame is pressed to be fixed to the surrounding edge of the seat board from all sides of the seat board, and the seat board is a vacuum-formed plastic board which has a thin thickness and is soft. When the surface plate is bearing weight, an inside of the surface plate has spreading tension so that the surface plate can bear heavy weight. In other words, the metal frame frames the seat board from all sides of the seat board to cause the surface plate to be in a suspended state. In this way, when subjected to weight, the force applied onto the surface plate is no longer applied to a single point of the surface plate, but is spread over the entire surface plate to obtain a larger support. Since both the seat board and the backrest are the vacuum-formed plastic boards, the thickness of the vacuum-formed plastic boards is small, and the material cost of the seat board and the backrest can be reduced. The metal frame is only a frame, so the manufacturing cost can be effectively reduced, and accordingly, the weight of the entire structure is effectively reduced.

2. The buckle edge is inserted into the slot or the insertion groove, and the buckle edge is pressed and fixed. The area or length of the connection between the backrest and the metal supporting frame is greatly improved, and there is no longer a single point or two points at which the backrest is connected to the metal supporting frame. Therefore, the backrest can be firmly installed on the metal supporting frame. Moreover, the buckle edge is clamped and fixed in the slot or the insertion groove by pressing, and the buckle edge is stressed on both sides and clamped stably. The buckle edge has a stable structure and is not easily damaged, so the buckle edge has a better service life.

DETAILED DESCRIPTION OF THE EMBODIMENTS

The present disclosure will be further described below in combination with the accompanying drawings and embodiments.

Figure 1:
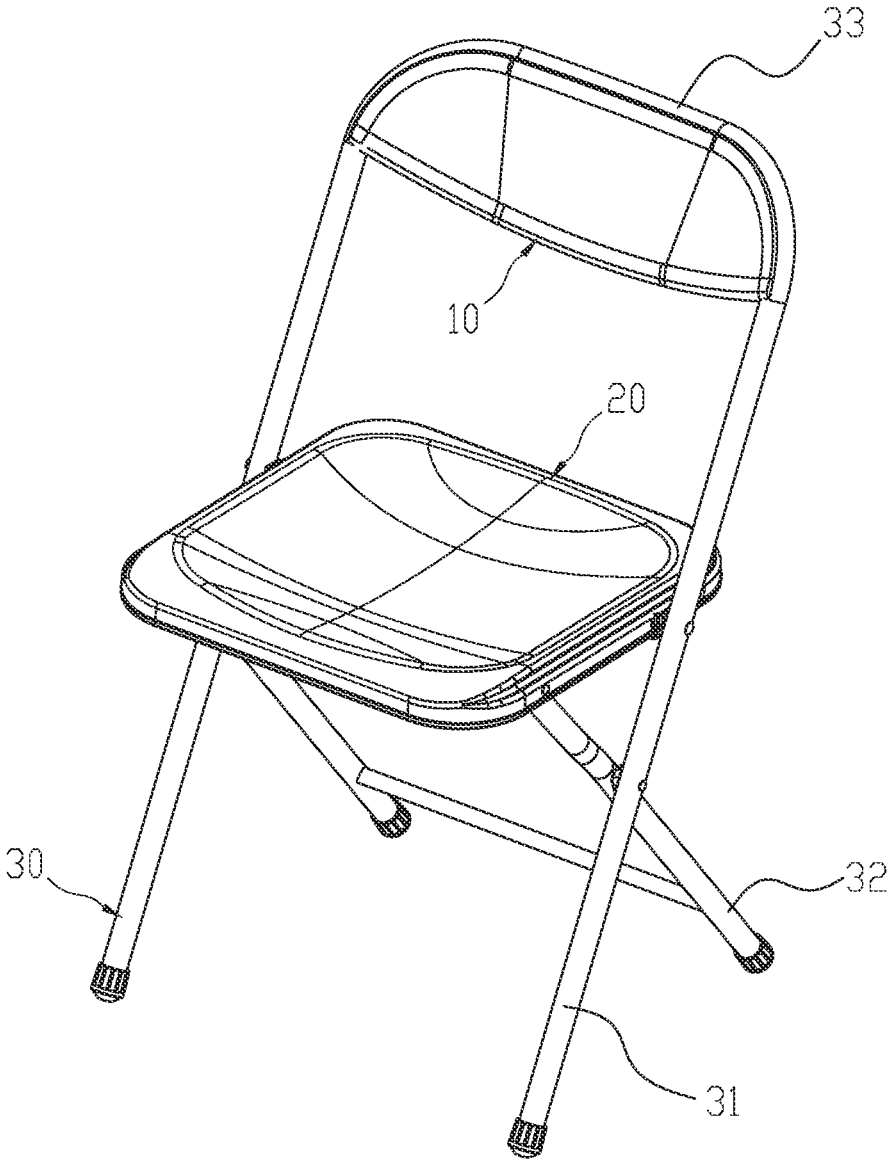
FIG. 1 illustrates a perspective view of a foldable plastic-steel chair in the present disclosure.

Referring to FIG. 1, a foldable plastic-steel chair is illustrated. The foldable plastic-steel chair comprises a backrest 10, a seat board assembly 20, and a metal supporting frame 30. The backrest 10 and the seat board assembly 20 are supported by the metal supporting frame 30 so as to make the seat board assembly 20 be configured to be folded with the metal supporting frame 30. The existing foldable chair structure can be referenced for the connection of the seat board assembly 20 and the metal supporting frame 30.

The metal supporting frame 30 comprises two front leg pipes 31 symmetrically disposed on a left side and a right side of the seat board assembly 20, and two rear leg pipes 32 symmetrically disposed on the left side and the right side of the seat board assembly 20. A corresponding one of the two front leg pipes 31 and a corresponding one of the two rear leg pipes 32 that are disposed on a corresponding side of the seat board assembly 20 are hinged to each other to define an X-shaped rotatable connection. The two front leg pipes 31 extend upward, and top ends of the two front leg pipes 31 are connected to each other by a connecting pipe 33. The two front leg pipes 31 cooperate with the connecting pipe 33 to define a U-shaped frame, and the backrest 10 is fixed on a top portion of the U-shaped frame. In this embodiment, the U-shaped frame is formed by bending a metal pipe. In this embodiment, the connection between the three major structures is the existing structure, so the folding principle of the plastic-steel chair will not be explained. The seat board assembly 20, the backrest 10, and a fixing method of the backrest 10 and the metal supporting frame 30 will be described below.

Figure 2:
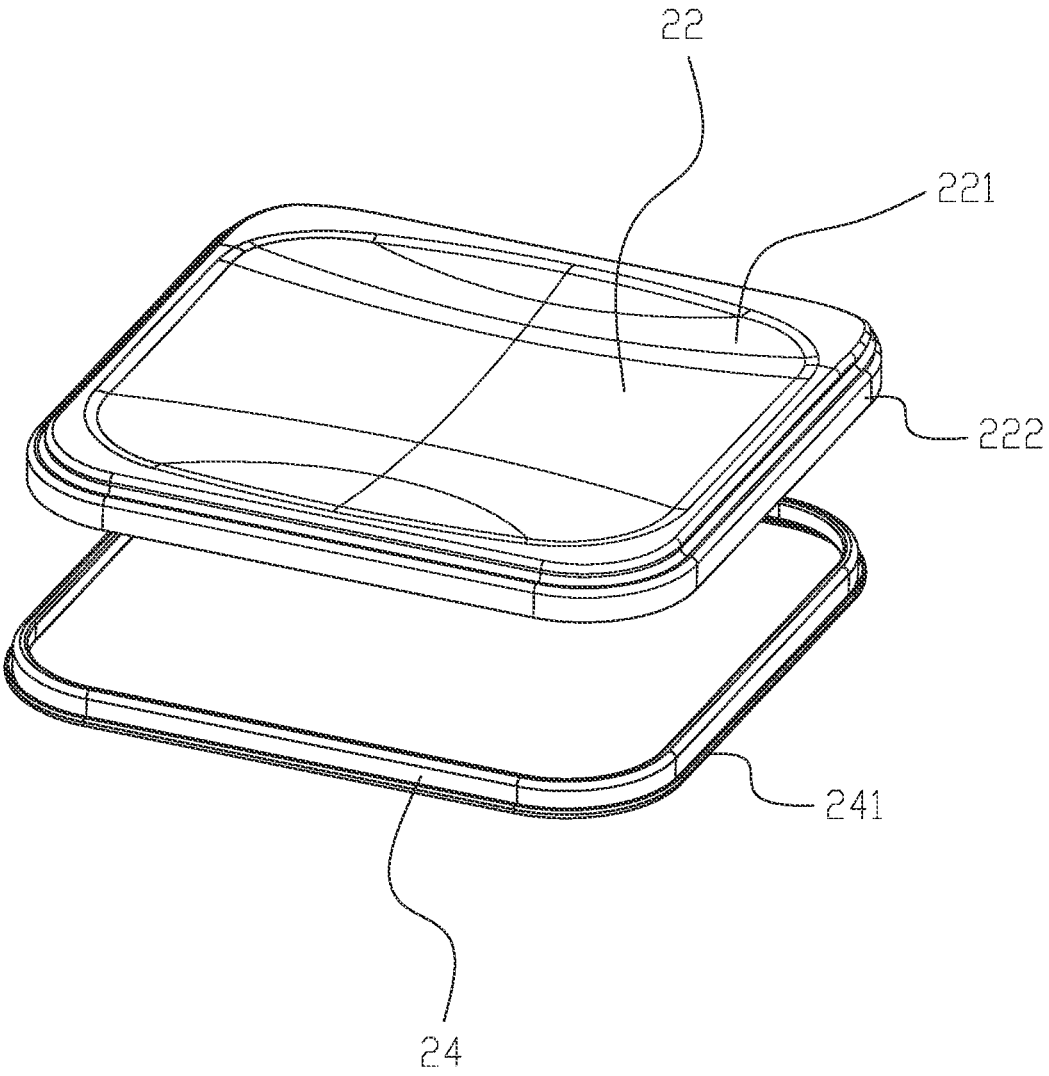
FIG. 2 illustrates an exploded view of a seat board assembly in the present disclosure.
Figure 3:
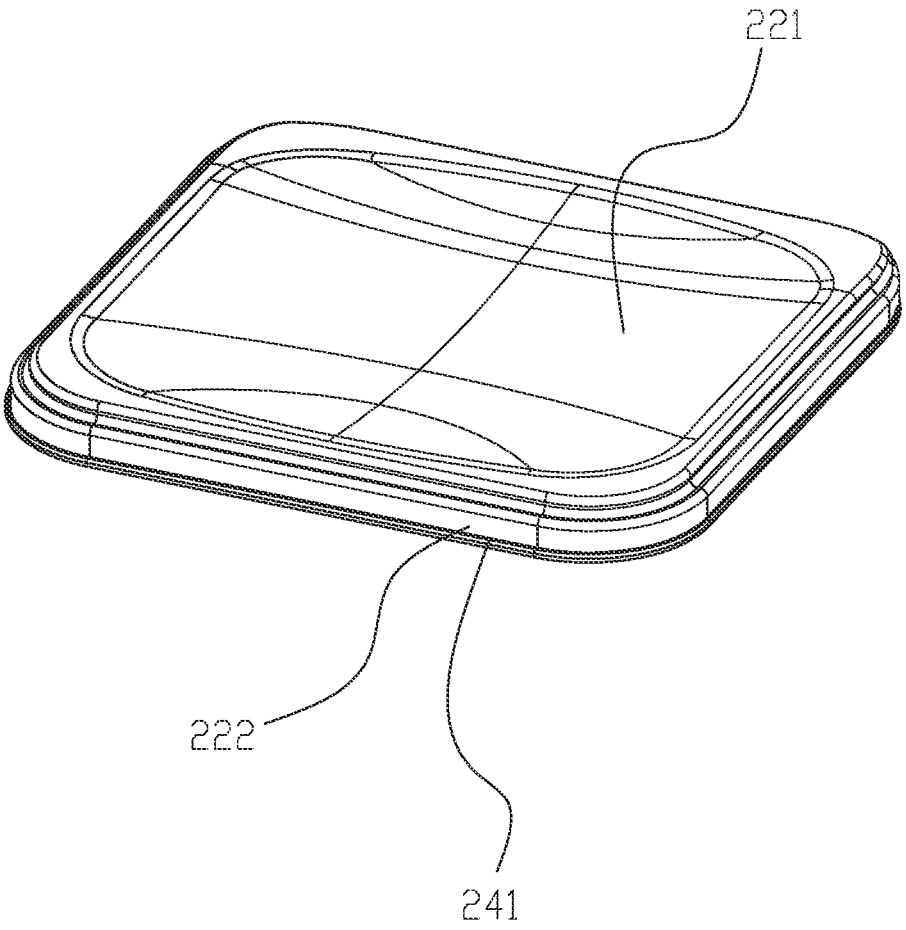
FIG. 3 illustrates a perspective view of the seat board assembly in the present disclosure.
Figure 4:
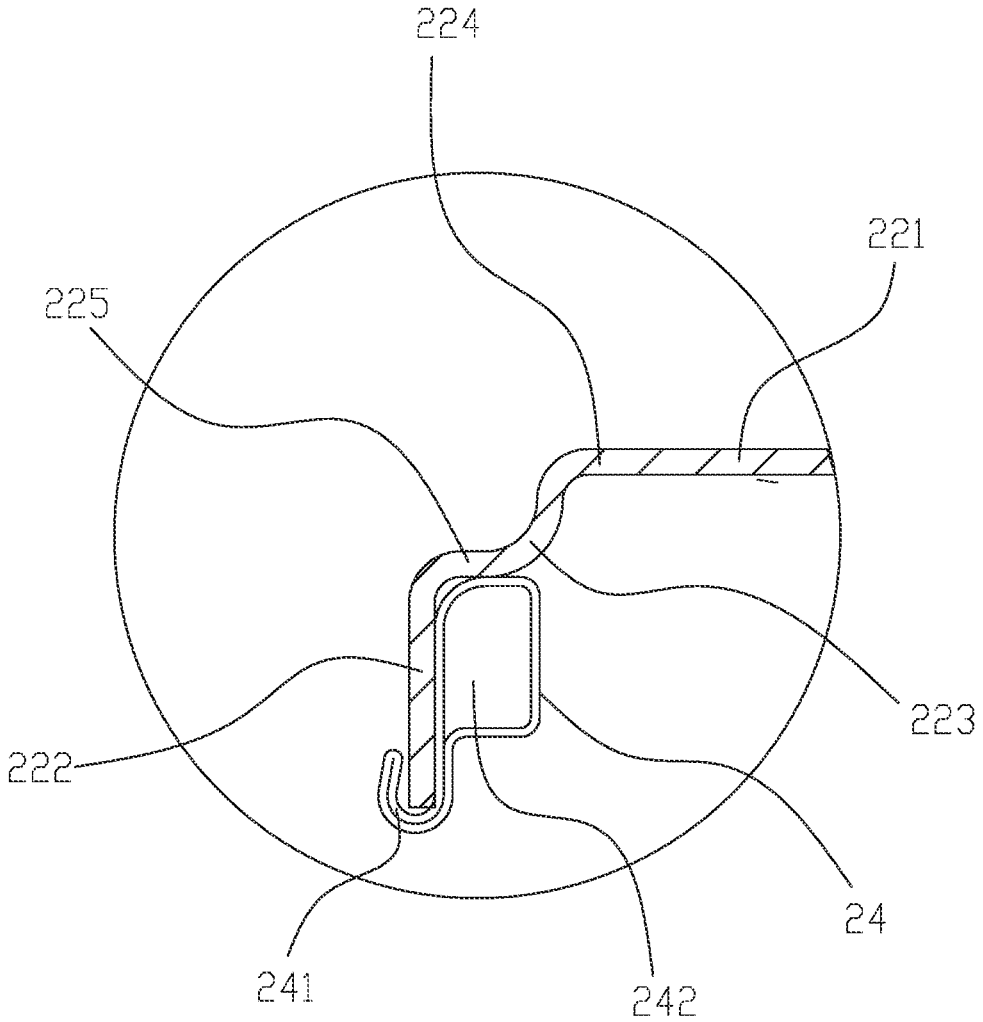
FIG. 4 illustrates a cross-sectional view of the seat board assembly in the present disclosure.

Referring to FIGS. 2 to 4, the seat board assembly 20 comprises a seat board 22 and a metal frame 24. The seat board 22 is a plastic board formed by vacuum forming, and a thickness of the seat board 22 is about 1 mm, or even about 0.5 mm. The seat board 22 is soft and flexible. The seat board 22 comprises a surface plate 221 and a surrounding edge 222 connected to edges of all sides of the surface plate 221 and extending downward. The metal frame 24 is annular, and the metal frame 24 is disposed around the seat board 22. A bottom end of the metal frame 24 is bent outward to form a hook 241. A lower end portion of the surrounding edge 222 of the seat board 22 is inserted into the hook 241 from an up-to-down direction, and the metal frame 24 abuts an inner side of the surrounding edge 222. The hook 241 is fixedly clamped to a lower edge of the surrounding edge 222 by pressing. That is, during assembly, the surrounding edge 222 can be inserted into the hook 241 first, and then the hook 241 is pressed to make the hook 241 be deformed and fixed to the surrounding edge 222, so that the seat board 22 is fixedly combined with the metal frame 24.

Preferably, a middle portion of the surface plate 221 is a concave structure, or the surface plate 221 is a concave structure. In this way, the surface plate 221 is not a flat surface, and the surface plate 221 has a curvature, has better stability, is not easy to deform, and has better tensile strength. The concave structure mentioned here does not necessarily have to be symmetrical along a front-and-rear direction and/or a left-and-right direction, as long as a portion of the concave structure that fits the human body is concave.

Preferably, a connecting portion of the surface plate 221 and the surrounding edge 222 extend inward to define an arc-shaped transition shoulder 223, so that an upper step 224 and a lower step 225 are formed between the surrounding edge and the surface plate. Therefore, a three-dimensional shape of the seat board 22 is more prominent, and a strong and heavy visual experience can be obtained by the user. Further preferably, the metal frame 24 provides a supporting force to the lower step 225, which will inevitably improve the load-bearing capacity of the seat board 22. Of course, the metal frame 24 can also provide a supporting force to the upper step 224 at the same time.

Preferably, a cross section of the metal frame 24 has an enclosed cavity 242. In this embodiment, a shape of the enclosed cavity 242 is rectangular. In this way, the metal frame 24 can actually be understood as a supporting pipe, which has better rigidity and strength.

Figure 5:
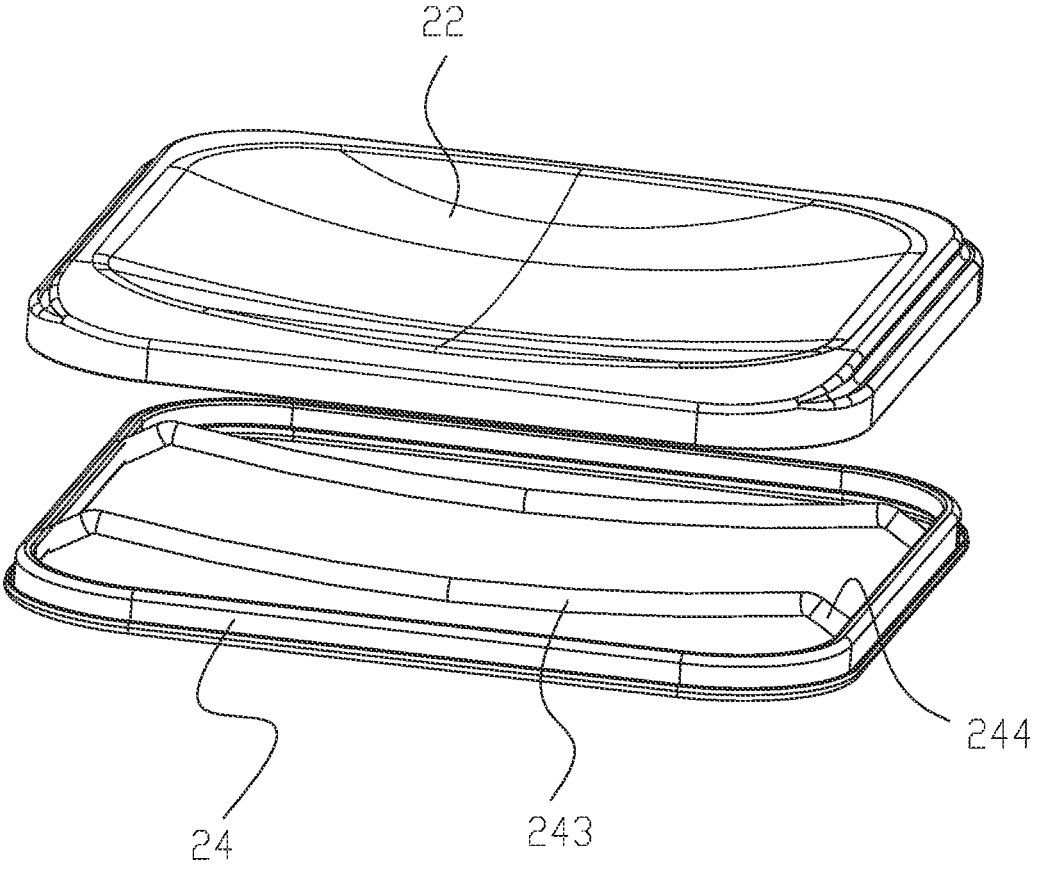
FIG. 5 illustrates an exploded view of the seat board assembly of a first alternative embodiment in the present disclosure.
Figure 6:
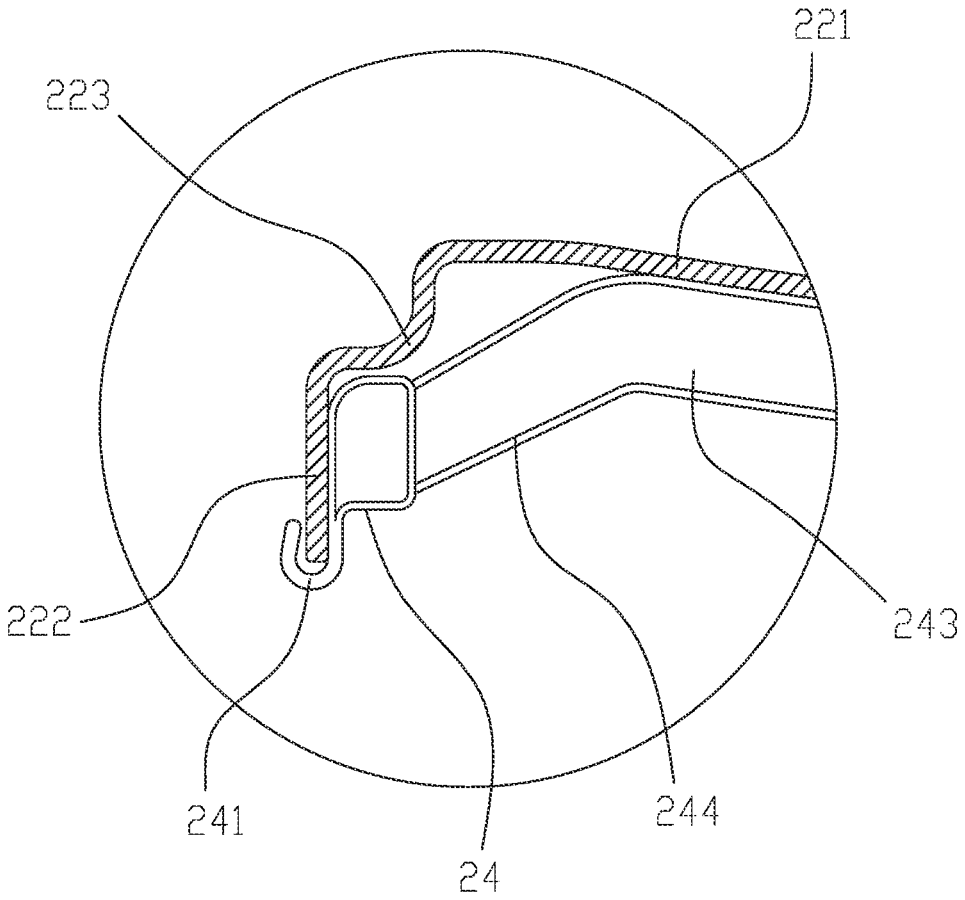
FIG. 6 illustrates a cross-sectional view of the seat board assembly of the first alternative embodiment in the present disclosure.

Referring to FIG. 5 and FIG. 6, a first alternative embodiment of the seat board assembly 20 is provided, and the seat board assembly 20 further comprises one or more reinforcing rods 243 connected to the metal frame 24. A lower surface of the surface plate 221 is supported on the one or more reinforcing rods 243. That is, the surface plate 221 is supported on the one or more reinforcing rods 243 so as to improve a weight capacity of the seat board assembly 20. As a preferred solution, each end of each of the one or more reinforcing rods 243 extends outward and is bent obliquely downward to form a connecting corner 244, and two connecting corners 244 at two ends of each of the one or more reinforcing rods 243 are in a splayed shape. The connecting corner 244 is connected to an inner surface of the metal frame 24. The connecting corner 244 is located at each end of each of the one or more reinforcing rods 243 and a length of the connecting corner 244 is short so that the connecting corner 244 is highly resistant to bending. Therefore, the one or more reinforcing rods 243 are not easily deformed when the surface plate 221 is supported on the one or more reinforcing rods 243.

Figure 7:
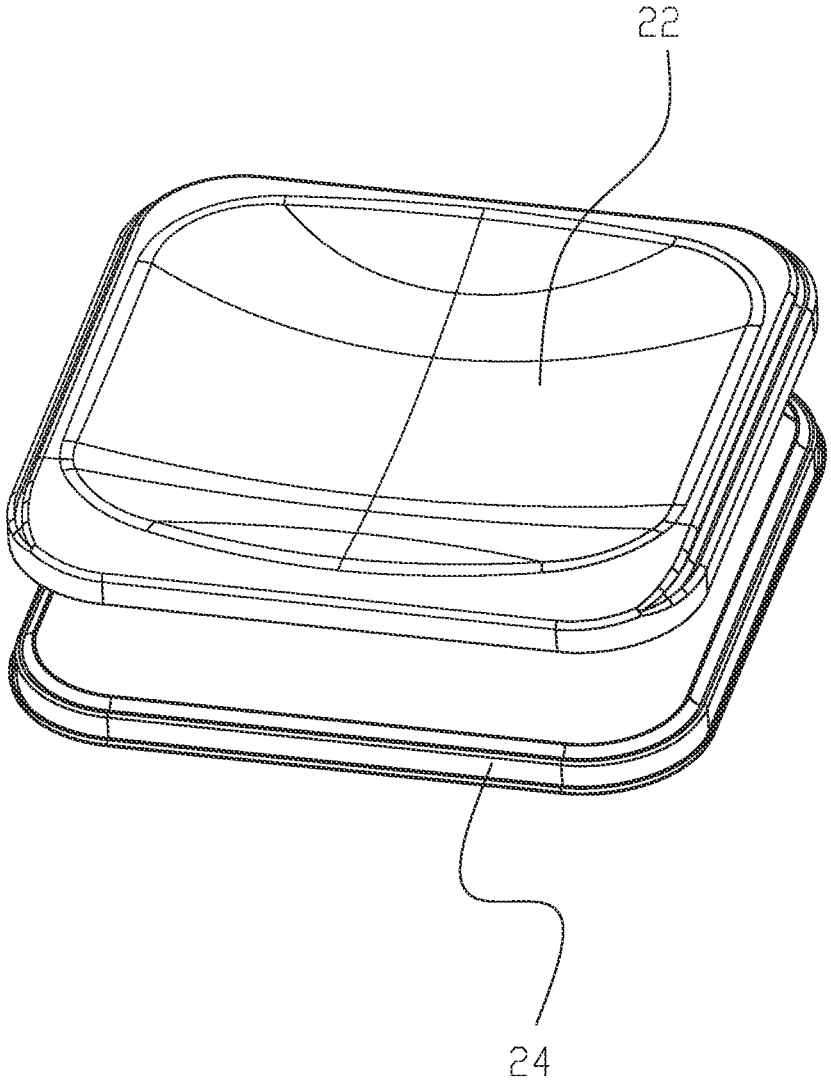
FIG. 7 illustrates an exploded view of the seat board assembly of a second alternative embodiment in the present disclosure.
Figure 8:
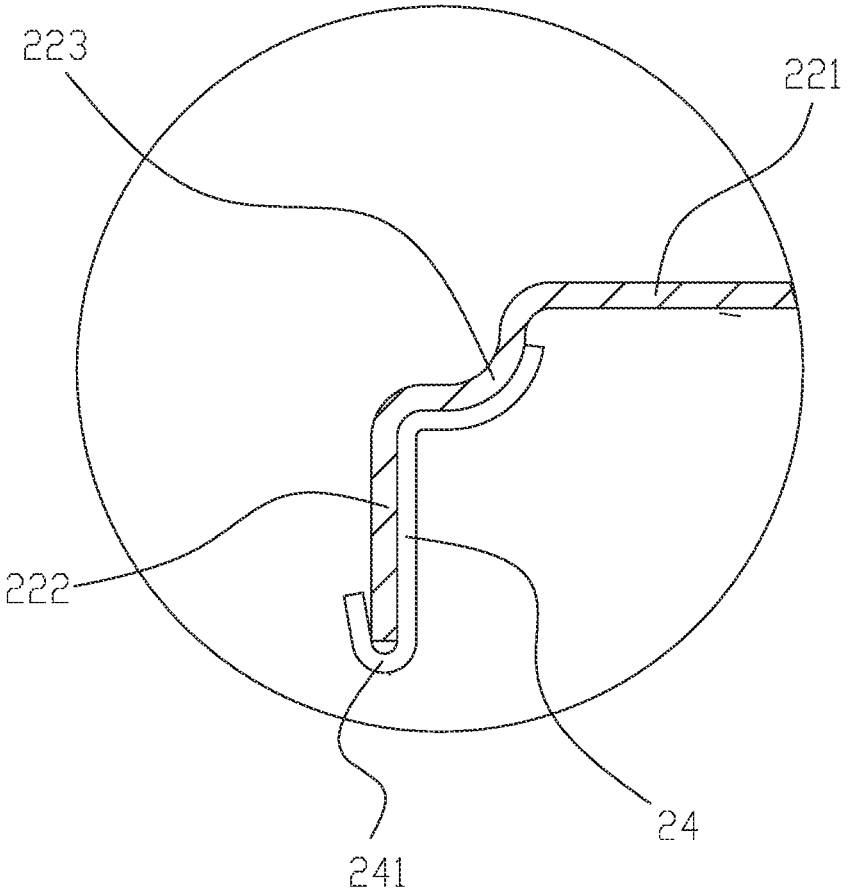
FIG. 8 illustrates a cross-sectional view of the seat board assembly of the second alternative embodiment in the present disclosure.

Referring to FIG. 7 and FIG. 8, a second alternative embodiment of the seat board assembly 20 is provided. The metal frame 24 is not a pipe structure, the enclosed cavity is omitted, and the metal frame 24 is a plate structure. That is, a cross section of the metal frame 24 has a uniform thickness. Further preferably, a shape of an upper end of the metal frame 24 corresponds to the arc-shaped transition shoulder 223 so as to abut a lower surface of the arc-shaped transition shoulder 223. Obviously, in the second alternative embodiment, the metal frame 24 can more easily provide support for the arc-shaped transition shoulder 223, or in other words, a supporting area of the metal frame 24 to the seat board 22 is larger.

Figure 9:
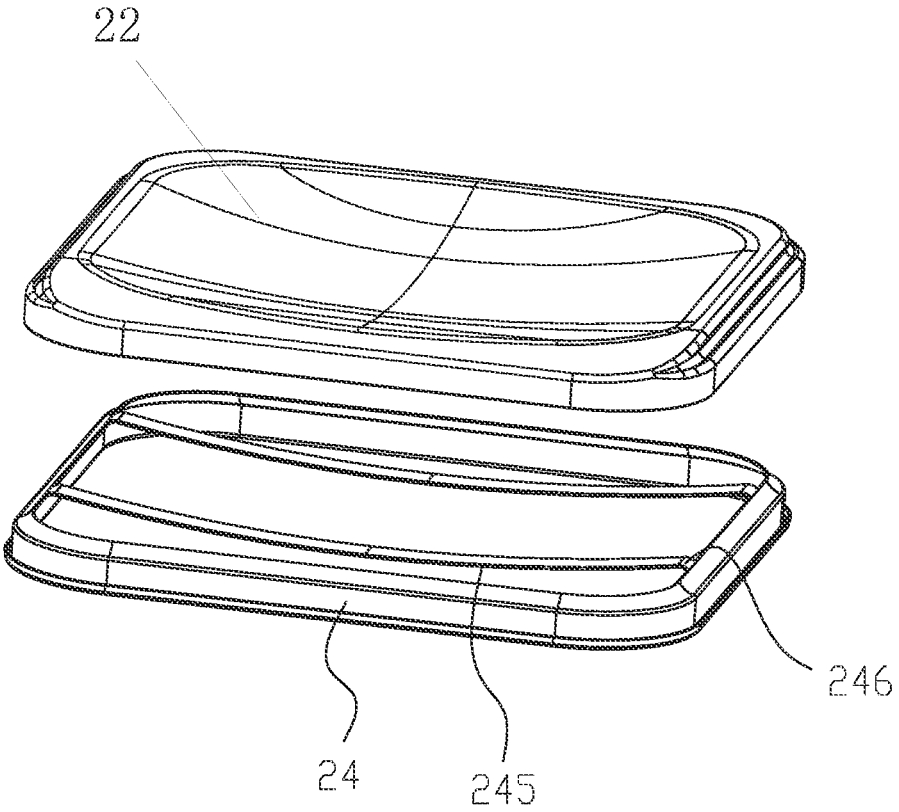
FIG. 9 illustrates an exploded view of the seat board assembly of a third alternative embodiment in the present disclosure.

Referring to FIG. 9, a third alternative embodiment of the seat board assembly 20 is provided and is similar to the first alternative embodiment. Specifically, the metal frame 24 is disposed with one or more elongated reinforcing sheets 245, and the lower surface of the surface plate 221 is supported on the one or more elongated reinforcing sheets 245. Preferably, each end of each of the one or more elongated reinforcing sheets 245 extends outward and is bent obliquely downward to form a connecting corner 246, and the connecting corner 246 is connected to a top end of the metal frame 24. The function of the one or more elongated reinforcing sheets is similar to the one or more reinforcing rods of the first alternative embodiment.

Figure 10:
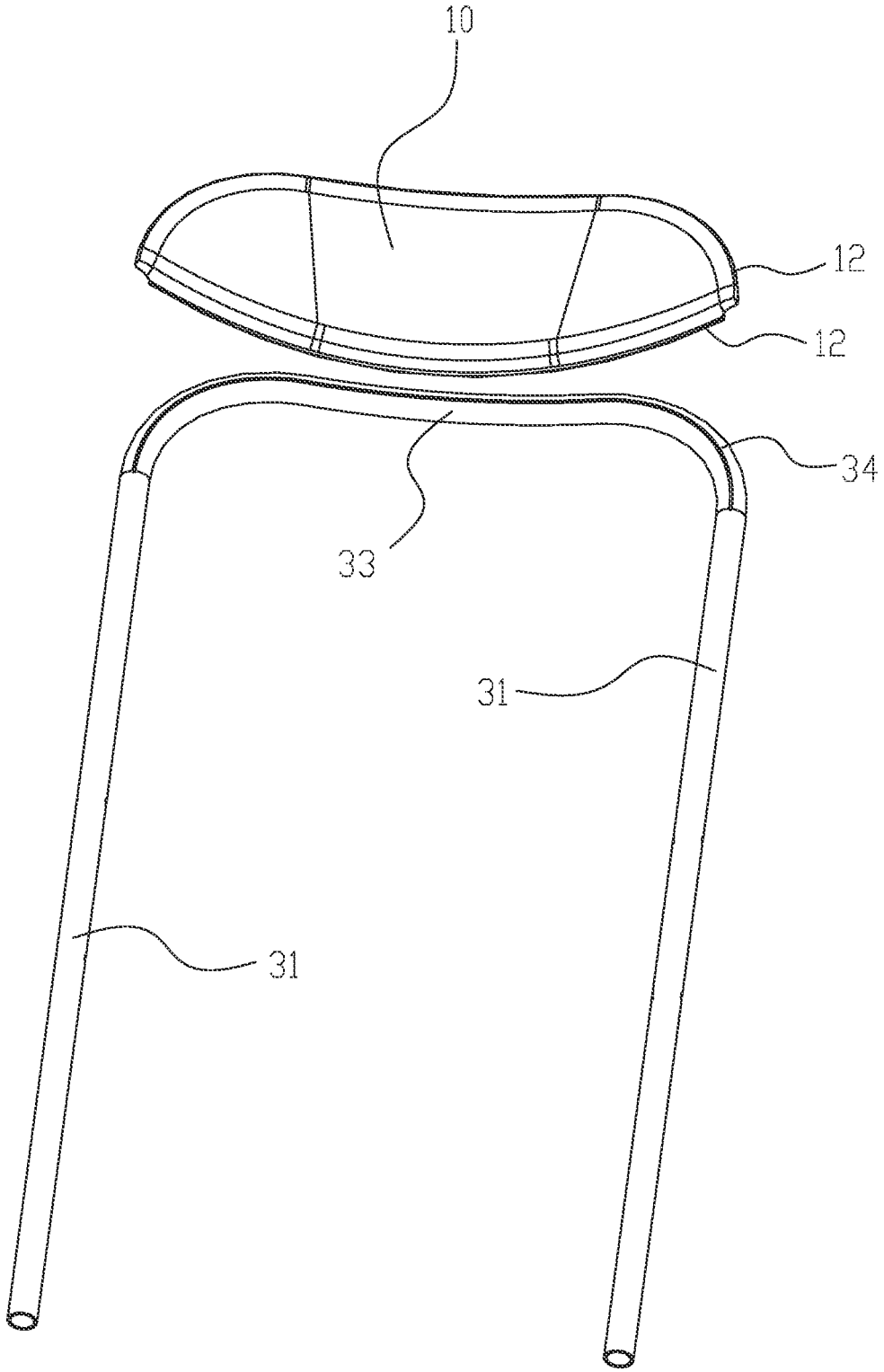
FIG. 10 illustrates an exploded view of a metal frame and a backrest in the present disclosure.
Figure 11:
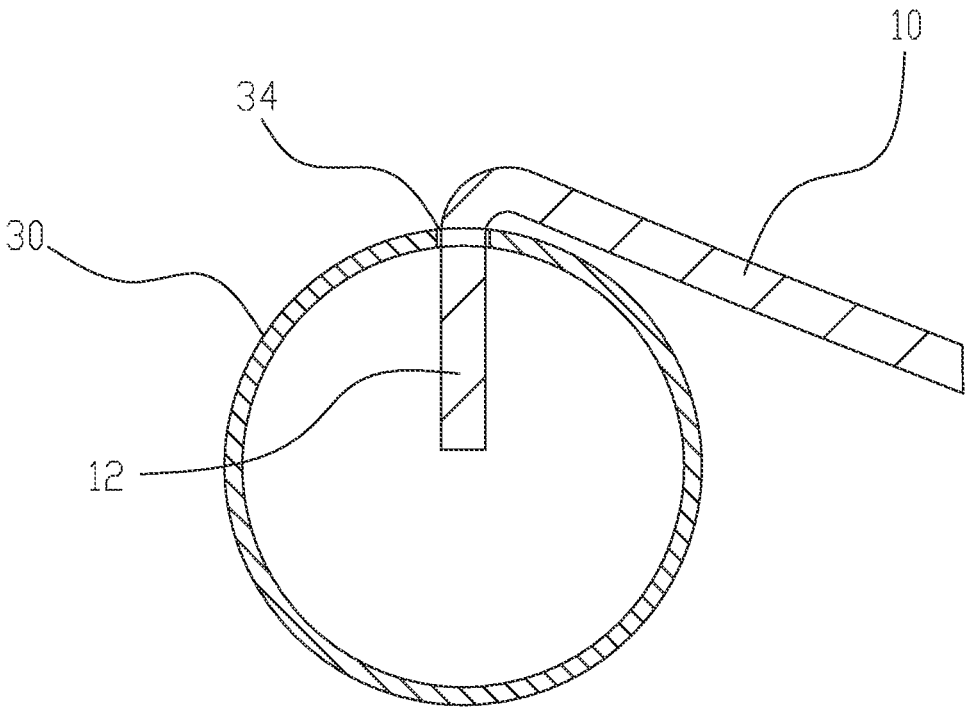
FIG. 11 illustrates a cross-sectional view of the metal frame and the backrest in the present disclosure.

Referring to FIG. 10 and FIG. 11, the backrest 10 is a vacuum-formed plastic board, an upper edge of the backrest 10 is at least folded rearward to form a buckle edge 12, and the metal supporting frame 30 comprises a slot 34 corresponding to the buckle edge 12. The buckle edge 12 is inserted into the slot 34, and the buckle edge 12 is fixedly clamped by the slot 34 after a position of the slot 34 of the metal supporting frame 30 is pressed. That is, during assembly, the buckle edge 12 is inserted into the slot 34 first, and then the metal supporting frame is pressed to be deformed to fix the buckle edge 12, so that the buckle edge 12 cannot be pulled out from the slot 34.

In this embodiment, the backrest 10 is disposed on a top of the U-shaped frame. That is, the backrest 10 is disposed on the connecting pipe 33 and a junction of the connecting pipe 33 and the two front leg pipes 31. Therefore, the slot 34 is correspondingly located on the connecting pipe 33 and the junction of the connecting pipe 33 and the two front leg pipes 31. The slot 34 corresponds to the buckle edge 12, and the slot 34 is rapid cut by laser.

Preferably, an entire outer edge of the backrest 10 is folded rearward to form the buckle edge 12. In this way, the buckle edge 12 is not only used for connection with the metal frame 24, but also the buckle edge 12 can increase the strength of all sides of the backrest 10, so that the backrest 10 has better strength and better stability. The entire outer edge of the backrest 10 forms the buckle edge 12, and the buckle edge 12 also comprises one or more gaps processed and formed at corners of the backrest 10.

Preferably, the backrest 10 has a shape of convex extending rearward, so that a loading capacity of the backrest 10 can be greatly improved. The backrest 10 is a vacuum-formed plastic board that can meet the requirements of use. Specifically, a thickness of the vacuum-formed plastic board is only about 0.5-1 mm, and the backrest 10 has a convex shape. After the entire outer edge of the backrest 10 is folded to form the buckle edge 12, the strength of the backrest 10 is greatly improved. Furthermore, the U-shaped frame is pressed to make a width of the slot 34 smaller and the buckle edge 12 can be firmly clamped by the slot 34. Therefore, not only is the cost of the metal supporting frame 30 very low, but the weight of the metal supporting frame 30 is also reduced. Under the premise of meeting the performance requirements, the weight of the foldable plastic-steel chair becomes lighter and the cost of the foldable plastic-steel chair becomes lower, making the foldable plastic-steel chair have good market competitiveness.

Figure 12:
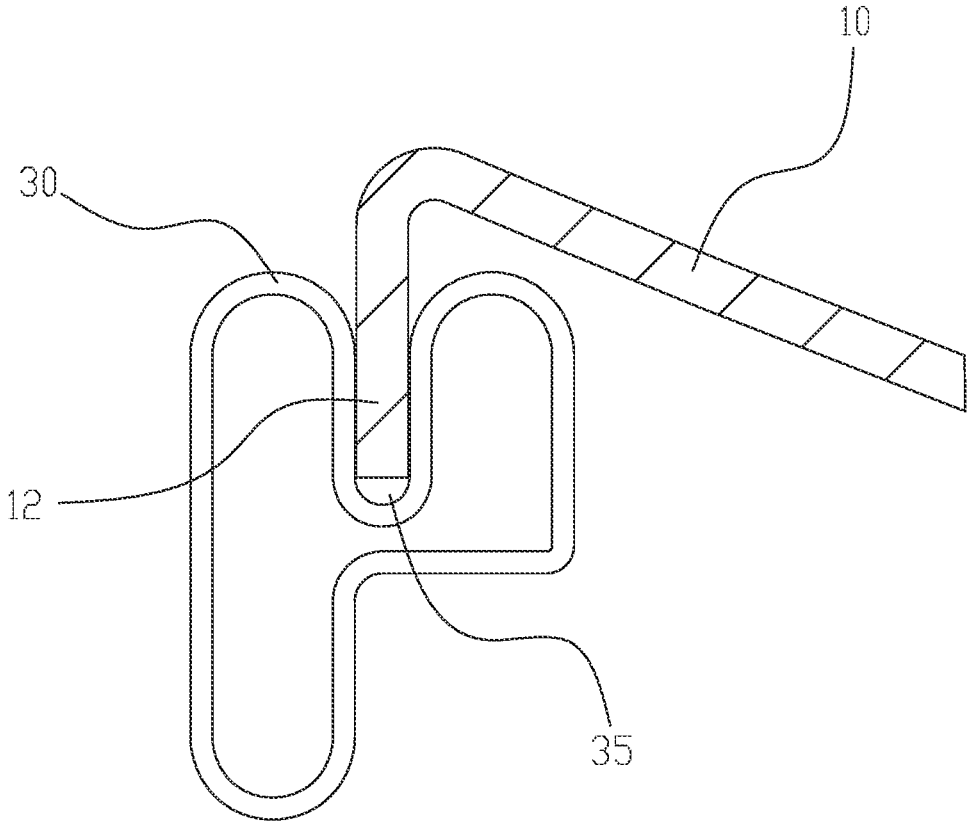
FIG. 12 illustrates a cross-sectional view of a metal supporting frame of a first alternative embodiment in the present disclosure.

The two front leg pipes 31 and the two rear leg pipes 32 are not necessarily round pipes. As an alternative embodiment of the metal supporting frame 30, referring to FIG. 12, a cross section of the metal supporting frame 30 can also have other shapes, as long as the buckle edge 12 of the backrest 10 can be clamped and fixed. In addition, referring to FIG. 12, the slot 34 can be omitted from the metal supporting frame 30, and the metal supporting frame 30 can comprise an insertion groove 35. The buckle edge 12 is disposed in the insertion groove 35, and the metal supporting frame 30 can be pressed to make the buckle edge 12 be clamped by the insertion groove 35.

Figure 13:
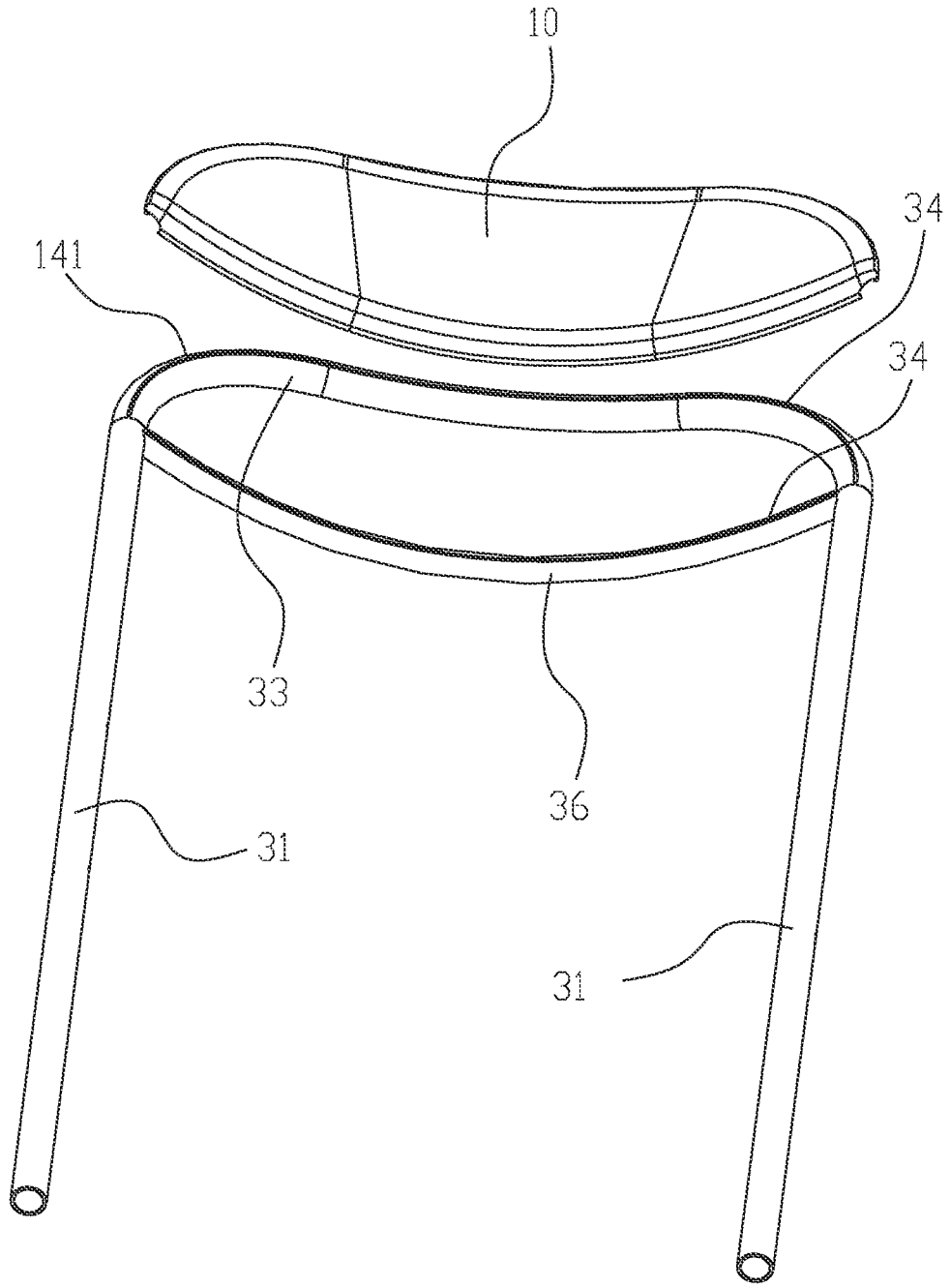
FIG. 13 illustrates an exploded view of the metal supporting frame of a second alternative embodiment in the present disclosure.

Referring to FIG. 13, as a second alternative embodiment of the metal supporting frame 30 is provided. The difference is that the metal supporting frame 30 also comprises a reinforcing cross pipe 36. Two ends of the reinforcing cross pipe 36 are respectively connected to a junction at which the two front leg pipes 31 are connected to the connecting pipe 33. The reinforcing cross pipe 36 also comprises a slot 34 which can also be replaced with an insertion groove, and the buckle edge 12 formed on the entire outer edge of backrest 10 is inserted into the slot 34. A lower edge of the backrest 10 is supported on the reinforcing cross pipe 36 to make the backrest 10 stronger.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foldable plastic-steel chair, comprising:

a seat board assembly, a backrest, and a metal supporting frame, wherein:

the seat board assembly and the backrest are connected to the metal supporting frame, the seat board assembly comprises a seat board, the seat board comprises a surface plate and a surrounding edge connected to a periphery of the surface plate and extending downward, the seat board is a vacuum-formed plastic board, the seat board assembly further comprises a metal frame abutting a periphery of the seat board, a bottom end of the metal frame is bent outward to form a hook, a lower end portion of the surrounding edge of the seat board is disposed in the hook, a portion of the metal frame abuts an inner side of the surrounding edge, the hook is fixedly clamped to a lower edge of the surrounding edge, a connecting portion of the surface plate and the surrounding edge define a transition shoulder, so that an upper step and a lower step are formed between the surrounding edge and the surface plate, and the lower step is at least supported by the metal frame.

2. The foldable plastic-steel chair according to claim 1, wherein:

the backrest is a second vacuum-formed plastic board, an upper edge of the backrest is at least folded rearward to form a buckle edge, the metal supporting frame comprises a slot or an insertion groove corresponding to the buckle edge, the buckle edge is disposed in the slot or the insertion groove, and the slot or the insertion groove is configured to be pressed to enable the buckle edge to be fixedly clamped by the slot or the insertion groove.

3. The foldable plastic-steel chair according to claim 2, wherein:

the backrest has a convex shape extending rearward.

4. The foldable plastic-steel chair according to claim 3, wherein:

an entire outer edge of the backrest is folded rearward to form the buckle edge, the metal supporting frame comprises two front leg pipes symmetrically disposed on a left side and a right side of the seat board assembly and two rear leg pipes symmetrically disposed on the left side and the right side of the seat board assembly, a corresponding one of the two front leg pipes and a corresponding one of the two rear leg pipes which are disposed on a corresponding side of the seat board assembly are hinged to each other to define an X-shaped rotatable connection, the two front leg pipes extend upward and top ends of the two front leg pipes are connected to each other by a connecting pipe, the two front leg pipes cooperate with the connecting pipe to define a U-shaped frame, the backrest is fixed on a top portion of the U-shaped frame, the U-shaped frame is formed by bending a metal pipe, and the slot or the insertion groove is located on a junction of the connecting pipe and the two front leg pipes.

5. The foldable plastic-steel chair according to claim 2, wherein:

a middle portion of the surface plate is a concave structure, or the surface plate is a concave structure.

6. The foldable plastic-steel chair according to claim 2, wherein:

the connecting portion of the surface plate and the surrounding edge extend inward to enable the transition shoulder to define an arc-shaped transition shoulder.

7. The foldable plastic-steel chair according to claim 2, wherein:

a cross section of the metal frame has an enclosed cavity, and a shape of the enclosed cavity is rectangular.

8. The foldable plastic-steel chair according to claim 2, wherein:

a cross section of the metal frame has a uniform thickness, the connecting portion of the surface plate and the surrounding edge extend inward to enable the transition shoulder to define an arc-shaped transition shoulder, and a shape of an upper end of the metal frame corresponds to the are shaped transition shoulder so as to abut a lower surface of the transition shoulder.

9. The foldable plastic-steel chair according to claim 1, wherein:

a middle portion of the surface plate is a concave structure, or the surface plate is a concave structure.

10. The foldable plastic-steel chair according to claim 1, wherein:

the connecting portion of the surface plate and the surrounding edge extend inward to enable the transition shoulder to define an arc-shaped transition shoulder.

11. The foldable plastic-steel chair according to claim 1, wherein:

a cross section of the metal frame has an enclosed cavity, and a shape of the enclosed cavity is rectangular.

12. The foldable plastic-steel chair according to claim 11, wherein:

the metal frame is disposed with one or more reinforcing rods, a lower surface of the surface plate is supported on the one or more reinforcing rods, each end of each of the one or more reinforcing rods extends outward and is bent obliquely downward to form a connecting corner, and the connecting corner is connected to an inner surface of the metal frame.

13. The foldable plastic-steel chair according to claim 1, wherein:

a cross section of the metal frame has a uniform thickness, the connecting portion of the surface plate and the surrounding edge extend inward to enable the transition shoulder to define an arc-shaped transition shoulder, and a shape of an upper end of the metal frame corresponds to the transition shoulder so as to abut a lower surface of the transition shoulder.

14. The foldable plastic-steel chair according to claim 13, wherein:

the metal frame is disposed with one or more elongated reinforcing sheets, a lower surface of the surface plate is supported on the one or more elongated reinforcing sheets, each end of each of the one or more elongated reinforcing sheets extends outward and is bent obliquely downward to form a connecting corner, and the connecting corner is connected to a top end of the metal frame.

15. The foldable plastic-steel chair according to claim 1, wherein:

an entire outer edge of the backrest is folded rearward to form a buckle edge, the metal supporting frame comprises two front leg pipes symmetrically disposed on a left side and a right side of the seat board assembly and two rear leg pipes symmetrically disposed on the left side and the right side of the seat board assembly, a corresponding one of the two front leg pipes and a corresponding one of the two rear leg pipes which are disposed on a corresponding side of the seat board assembly are hinged to each other to define an X-shaped rotatable connection, the two front leg pipes extend upward and top ends of the two front leg pipes are connected to each other by a connecting pipe, the two front leg pipes cooperate with the connecting pipe to define a U-shaped frame, the backrest is fixed on a top portion of the U-shaped frame, the U-shaped frame is formed by bending a metal pipe, and a slot or an insertion groove is located on a junction of the connecting pipe and the two front leg pipes.

16. The foldable plastic-steel chair according to claim 15, wherein:

the metal supporting frame comprises a reinforcing cross pipe, two ends of the reinforcing cross pipe are respectively connected to the junction at which the two front leg pipes are connected to the connecting pipe, the slot or the insertion groove extends along the reinforcing cross pipe and the connecting pipe, and the buckle edge is disposed in the slot or the insertion groove.

17. A foldable plastic-steel chair, comprising:

a seat board assembly, a backrest, and a metal supporting frame, wherein:

the seat board assembly and the backrest are connected to the metal supporting frame, the seat board assembly comprises a seat board, the seat board comprises a surface plate and a surrounding edge connected to a periphery of the surface plate and extending downward, the backrest is a vacuum-formed plastic board, an upper edge of the backrest is at least folded rearward to form a buckle edge, the metal supporting frame comprises a slot or an insertion groove corresponding to the buckle edge, the buckle edge is disposed in the slot or the insertion groove, and the slot or the insertion groove is configured to be pressed to enable the buckle edge to be fixedly clamped by the slot or the insertion groove.

18. The foldable plastic-steel chair according to claim 17, wherein:

the seat board is a vacuum-formed plastic board, the seat board assembly further comprises a metal frame abutting a periphery of the seat board, a bottom end of the metal frame is bent outward to form a hook, a lower end portion of the surrounding edge of the seat board is disposed in the hook, a portion of the metal frame abuts an inner side of the surrounding edge, and the hook is fixedly clamped to a lower edge of the surrounding edge.

19. The foldable plastic-steel chair according to claim 18, wherein:

a cross section of the metal frame has a uniform thickness, a connecting portion of the surface plate and the surrounding edge extend inward to define an arc-shaped transition shoulder, so that an upper step and a lower step are formed between the surrounding edge and the surface plate, and a shape of an upper end of the metal frame corresponds to the arc-shaped transition shoulder so as to abut a lower surface of the arc-shaped transition shoulder.

20. A foldable plastic-steel chair, comprising:

a seat board assembly, a backrest, and a metal supporting frame, wherein:

the seat board assembly and the backrest are connected to the metal supporting frame, the seat board assembly comprises a seat board, the seat board comprises a surface plate and a surrounding edge connected to a periphery of the surface plate and extending downward, the seat board is a vacuum-formed plastic board, the seat board assembly further comprises a metal frame abutting a periphery of the seat board, a bottom end of the metal frame is bent outward to form a hook, a lower end portion of the surrounding edge of the seat board is disposed in the hook, a portion of the metal frame abuts an inner side of the surrounding edge, the hook is fixedly clamped to a lower edge of the surrounding edge, a cross section of the metal frame has an enclosed cavity, and a shape of the enclosed cavity is rectangular.

* * * * *